United States Patent [19]

Mahoney

[11] Patent Number: 4,930,903

[45] Date of Patent: Jun. 5, 1990

[54] GIFT WRAPPING PACKAGE

[75] Inventor: William M. Mahoney, North Falmouth, Mass.

[73] Assignee: William-Maher, Inc., Dallas, Tex.

[21] Appl. No.: 378,318

[22] Filed: Jul. 11, 1989

[51] Int. Cl.[5] ..... B65D 30/16; B65D 30/20; B65D 33/02; B65D 33/06

[52] U.S. Cl. ..... 383/6; 383/26; 383/33; 383/104; 383/121.1; 383/80

[58] Field of Search ..... 383/6, 26, 104, 119, 383/121.1, 33, 80, 120; 229/87 R

[56] References Cited

U.S. PATENT DOCUMENTS

| | | | |
|---|---|---|---|
| 1,846,542 | 2/1932 | Budd | 383/119 X |
| 2,650,016 | 8/1953 | McMillan | 383/119 X |
| 3,006,532 | 10/1961 | Fine | 383/6 |
| 3,129,848 | 4/1964 | Canno | 383/119 X |
| 3,301,453 | 1/1967 | Stewart | 383/119 X |
| 3,349,992 | 10/1967 | Skinner | 383/26 X |
| 3,682,372 | 8/1972 | Rodley | 383/104 |
| 4,115,909 | 9/1978 | Corella | 383/104 X |

FOREIGN PATENT DOCUMENTS

| | | | |
|---|---|---|---|
| 371989 | 10/1963 | Switzerland | 383/119 |

*Primary Examiner*—Stephen Marcus
*Assistant Examiner*—Jes F. Pascua
*Attorney, Agent, or Firm*—G. Turner Moller

[57] ABSTRACT

A gift wrap package includes a paper bag of conventional type having a square folded bottom and side folds providing a bag of generally rectilinear shape. An insert inside the bag supports one or more of the bag sides and gives the bag the appearance of a box. A rectilinear lid closes the open mouth of the bag. In one embodiment, a pair of handles are affixed to the bag and extend through slots in the lid. In another embodiment, the handles are attached to an intermediate portion of the bag and extend alongside the lid. Suitable ribbons or bows may be applied to the package.

14 Claims, 2 Drawing Sheets

GIFT WRAPPING PACKAGE

This is a continuation of application Ser. No. 07/232,225, filed Aug. 15, 1988, now abandoned.

This invention relates to a special package that may be used to wrap gifts.

At the present time, many retailers offer to gift wrap purchases because customers want such a service. In a small retail or store or boutique, the sales clerk may perform such a service. On the other hand, larger department stores typically provide a separate gift wrap department in an attempt to provide greater labor productivity, reduce material wastage and to minimize congestion and delay at the cash registers. In such situations, department stores charge what appears to the customer to be a pretty stiff price for a simple chore. The truth of the matter is that gift wrap departments are not money makers because of inherent labor inefficiencies—there is either not enough to do and employees are being paid to stand around or there is too much to do and customers are waiting.

This problem has been recognized for some time and at least one attempt has been made to provide a gift wrap package which can easily and quickly be used to wrap a purchase as shown in U.S. Pat. No. 3,489,333. Although this product has been offered for sale for many years, it has never achieved universal acceptance. Other disclosures of some interest relative to this invention are found in U.S. Pat. Nos. 1,139,128; 1,139,281; 2,269,796; 4,037,778 and U.S. Pat. No. 4,338,979.

In summary, this invention relates to a gift wrap package including a high quality bag made of paper, laminated paper, plastic or the like which is shipped in a folded or collapsed condition. At the point of use, the bag is unfolded and an insert is placed in the bag to provide lateral support for the sides of the bag thereby converting the bag into what appears to be a box. The gift or purchase is wrapped with tissue paper or other suitable packing material and placed inside the bag. A relatively rigid lid is placed over the open mouth of the bag thereby completing the appearance of a box.

The bag preferably provides one or more handles extending past the open mouth and lid. The handles and lid are arranged to be compatible and not interfere with one another. In one embodiment, the lid provides a pair of elongate slots receiving the handles therethrough. In another embodiment, the handles are connected to the bag sides substantially below the bag top whereby the handles lie along the sides of the lid.

It is an object of this invention to provide an improved gift wrapping package.

Another object of this invention is to provide a gift wrapping package in which a collapsed bag is converted into a box appearing structure.

A further object of this invention is to provide a gift wrapping package including a bag having one or more handles affixed thereto and a lid compatible with the handle.

These and other objects and advantages of this invention will become more fully apparent as this description proceeds, reference being made to the accompanying drawings and appended claims.

IN THE DRAWINGS

Figure 1:
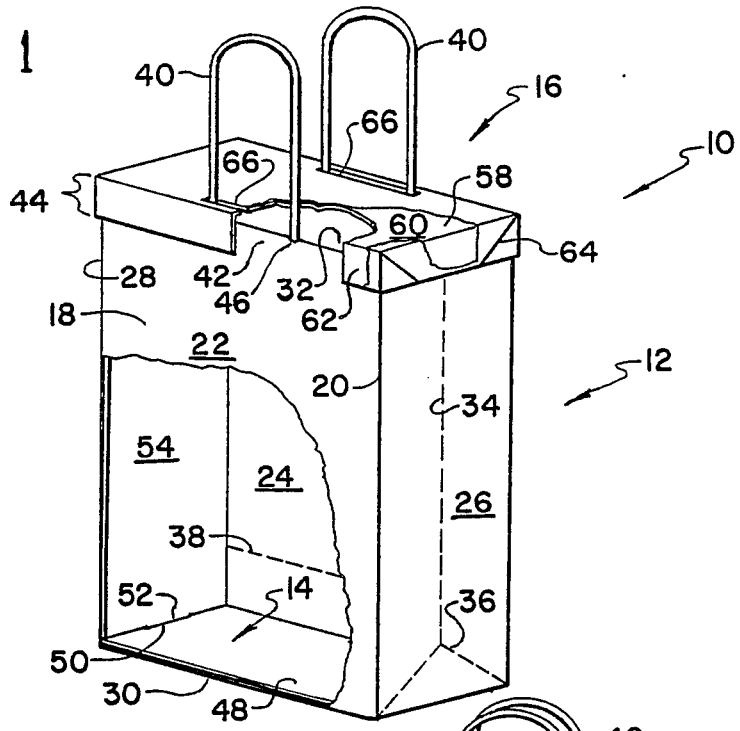
FIG. 1 is an isometric view of one embodiment of a gift wrap package of this invention, certain parts being broken away for clarity of illustration.
Figure 3:
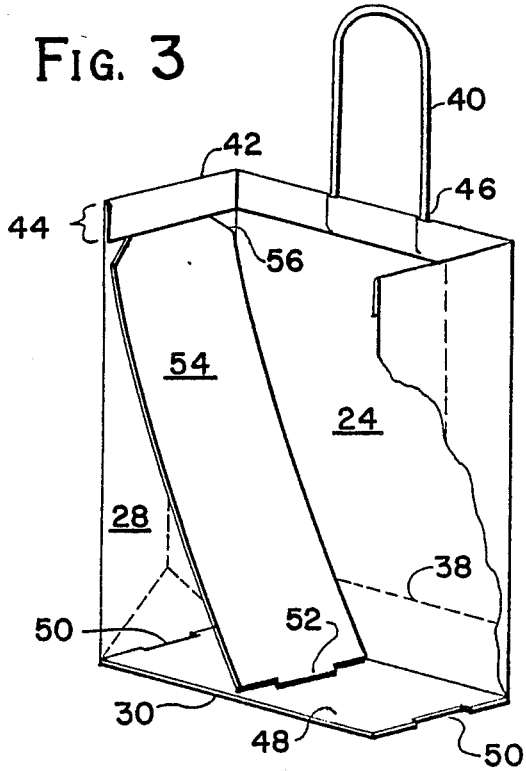
FIG. 3 is an isometric view of one embodiment of the insert and bag, illustrating how the insert supports the bag.
Figure 2:
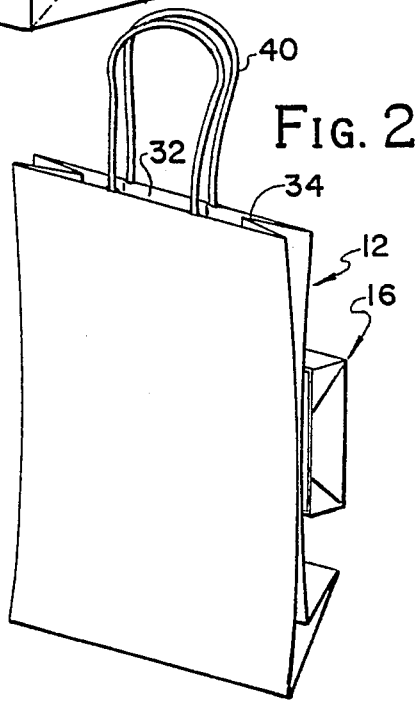
FIG. 2 is an isometric view of the collapsed or shipping configuration of the package of FIG. 1.

Referring to FIGS. 1–3, there is illustrated a gift wrap package 10 of this invention comprising, as major components, a bag 12, an insert 14 and a lid 16.

The bag 12 is desirably made of a high quality bodily flexible sheet material 18 such as high quality paper, laminated paper, plastic or the like. The bag 12 is of conventional design including four longitudinal folds 20 dividing the bag 12 into parallel front and back walls 22, 24, and parallel side walls 26, 28. The bottom of the bag 12 is folded, as in an envelope or modified envelope fold, to provide a flat bottom 30 of polygonal shape which is preferably rectilinear. As used herein, rectilinear means square or rectangular. The bag 12 can be folded between a conventional collapsed position shown in FIG. 2 and an open position providing a mouth 32 opening into and providing access to the interior of the bag 12. To this end, the side walls 26, 28 provide central longitudinal creases or folds 34 and a pair of diagonal folds 36 and the back wall 24 provides a transverse crease 38.

The bag 12 is preferably provided with a pair of mirror image handles 40. The handles 40 may be of any suitable type and are illustrated as relatively stiff cord like members connected to the bag 12 in a conventional manner. The upper end 42 of the bag 12 is reverted in a region 44 of double material thickness. A pair of openings 46 are provided in the fold of the upper end 42. The handles 40 extend through the openings 46 and are secured, in any suitable fashion to the bag 12. The handles 40 are accordingly parallel to the plane of the front and back walls 22, 24. Many of the techniques for attaching the handles 40 to the bag 12 involve the use of adhesives which also secures the upper end 42 in a permanently folded position. It will accordingly be seen that the bag 12, as heretofore described, is a more-or-less conventional handled bag that is commercially available for a wide variety of sources.

The insert 14 is substantially stiffer than the sheet material 18. Referring to FIGS. 1 and 3, one embodiment of the insert 14 includes a panel 48 permanently secured, as by adhesives or the like, to the flat bottom 30 of the bag 12. The panel 48 provides a pair of recesses 50 to receive a tab 52 of a pair of upright insert sections 54. EAch insert section 54 is about the same width, or slightly smaller, than the side walls 26, 28. The upper end 56 of the insert section 54 is beveled to allow the end 56 to be easily tucked under the fold of the upper bag end 42. In one version, the insert section 54 is of such a length that is stretches the side walls 26, 28 of the bag 12 and places the insert section 54 slightly in compression. This provides a slightly better appearing package but is somewhat more difficult to install the section 54. In another version, the insert section 54 is slightly shorter and merely supports the bag side walls 26, 28 but does not place them in tension.

To place the insert sections 54 in position, each section 54 is placed inside the bag 10 and the upper end 56 is tucked under the fold provided by the upper bag end 42. The lower end of the section 54 is then moved toward the side walls 26, 28 until the tab 52 enters the recess 50 thereby snapping each insert section 54 in place.

The lid 16 comprises a sheet of material 58 substantially stiffer than the sheet material 18. The sheet 58 is folded to provide a top panel 60 and a peripheral skirt 62 which is the same shape as the mouth 32 of the bag 12. Thus, the lid 16 is preferably rectilinear. The sheet material 18, particularly as supported by the insert 14, is sufficiently stiff to stand upright in the open position of the bag 12. The lid 16 accordingly overlies and closes the open mouth 32 of the bag 12.

The lid 16 is preferably covered with a decorative sheet of material 64 of the same finish as the sheet 18 to provide an artistic and pleasing appearance for the package 10. The sheet 64 is desirably folded under the skirt 62 and secured to the lid 16, as by the use of adhesive, tape or the like, on the underside of the top panel 60.

The handles 40 and the lid 16 should not interfere with one another. To this end, the lid 16 provides a pair of elongate parallel slots 66 receiving the handles 40 and allowing the handles 40 pass beyond the lid 16.

Use of the package 10 should now be apparent. When a customer desires a purchase to be wrapped, the clerk retrieves one of the packages 10 of this invention which are delivered in the collapsed configuration of FIG. 2. This may occur at the point of sale, such as a cash register, or at a separate gift wrap department. The clerk opens the bag 12, places the insert sections 54 therein, wraps the purchase in tissue paper or other suitable packing material, inserts the wrapped purchase into the bag 12, threads the handles 40 through the lid 16, and places the lid 16 on the open mouth 32 of the bag 12. If desired, suitable decorative ribbons (not shown) may be wrapped about the bag 12 and lid 16 and decorative ribbon bows (not shown) or other decorations, tags or the like may be affixed to the package 10.

The time necessary to place the purchase in the package 10 and complete the wrapping is not substantially more than is necessary to place the purchase in an ordinary shopping bag. Thus, the retailer can charge a modest sum to gift wrap the purchase, complete the gift wrap and send the customer happily on her way in short order. The package 10, when artistically executed, in a very spiffy package indeed. Thus, there is obtained a high order of customer acceptance as a high quality gift wrap. The customer can easily carry the package 10 out of the store by using the handles 40.

For use in a gift wrap department, the package 10 provides a technique for quickly wrapping a gift. At the sales desk, the package 10 allows the sales clerk to wrap the gift and complete the transaction thereby reducing the ultimate demand on the gift wrap department.

Many people save ribbons or other decorations from wrapped gifts. To open a conventional gift wrapped package requires that the wrapping material be torn thereby effectively destroying the package. In contrast, the package 10 of this invention is reusable. Thus, the purchaser of the gift and the recipient perceive additional value from the packages of this invention.

In a deluxe version of the package 10, the lid 16 is a relatively expensive component of this invention, largely because of the labor involved in wrapping the decorative sheet material 58. Although lower costs can be achieved by lower quality treatment, it is desirable to reduce the costs of the lid 16. In addition it may be desirable to provide decorative material on the lid which is applied during manufacture of the package 10. For example, it may be desirable to provide a ribbon (not shown) extending across or along the lid 16. In the embodiments of FIGS. 1–3, it is evident that a centrally disposed ribbon can only be applied in a direction extending parallel to the long dimensions of the lid 16 because the ribbon would interfere with the handles 40. Accordingly, it may be desirable to provide a slightly modified lid to obviate these disadvantages.

Figure 4:
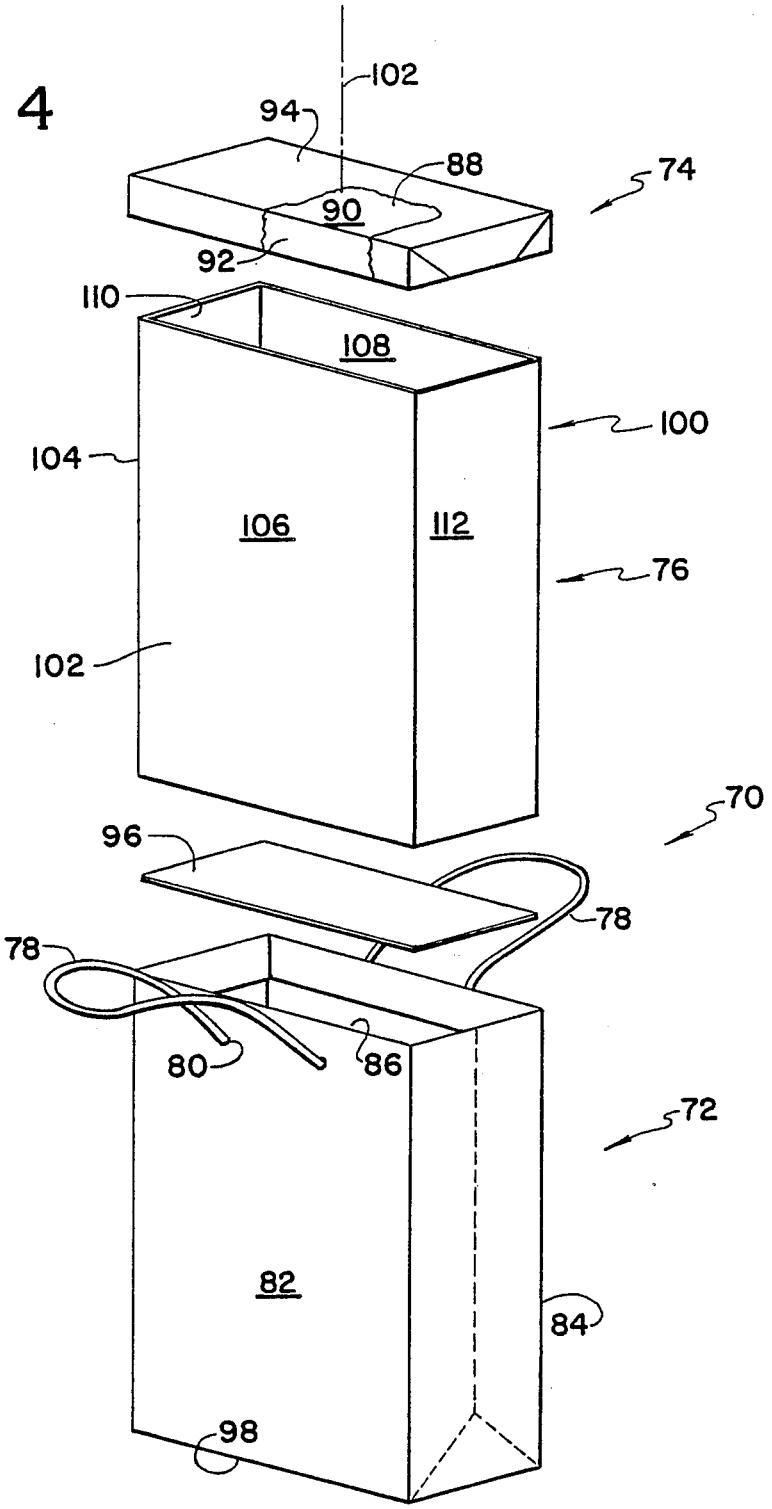
FIG. 4 is an isometric view of another embodiment of a gift wrap package of this invention illustrating a modified insert and a modified handle structure.

Referring to FIG. 4, there is illustrated another embodiment 70 of the gift wrap package of this invention comprising, as major components, a bag 72, a lid 74 and an insert 76.

The bag 72 is desirable substantially identical to the bag 12 except for the handles 78 exit through openings 80 in the front and rear walls 82, 84 at a location slightly below the top edge or mouth 86 of the bag 72. The location of the openings 88 is spaced below the edge 86 a distance at least as great as the depth of the skirt of the lid 76 as will be more fully explained hereinafter.

The lid 74 comprise a sheet of material 88 substantially stiffer than the material of the bag 72. The sheet 88 is folded to provide a top panel 90 and a peripheral skirt 92 which is the same shape as the mouth 86 of the bag 72. Thus, the lid 74 is preferably rectilinear. The sheet material of the bag 72, particularly as supported by the insert 76, is sufficiently stiff to stand upright in the open position of the bag 72. The lid 74 accordingly overlies and closes the open mouth 32 of the bag 72.

The lid 74 is preferably covered with a decorative sheet of material 94 of the same finish as the bag 72 to provide an artistic and pleasing appearance for the package 70. The sheet 94 is desirably folded under the skirt 92 and secured to the lid 74, as by the use of adhesive, tap or the like, on the underside of the top panel 90.

The handles 78 and the 74 should not interfere with one another. In the embodiment of FIG. 4, this is accomplished because the handles 78 extend along the outside of the lid 74 and accordingly pass beyond the lid 74. In this fashion, a ribbon or other decoration can be applied to the lid 74 during manufacture which would lie across the area occupied by the slots 66 of the lid 16. Thus, the lid 74 has the potential to be decorated during manufacture thereby reducing wrapping time and effort by the department store or end user.

The insert 76 is of different construction than the inset 14. The insert 76 is substantially stiffer than the sheet material of the bag 72 and includes a bottom panel 95 permanently secured, as by adhesives or the like, to the flat bottom 98 of the bag 72.

The insert 76 includes a hollow or open ended box shaped structure 100 comprising a stiff sheet of material 102 folded along four parallel fold lines 104 to provide parallel front and rear walls 106, 108 only slightly smaller than the front and rear walls of the bag 72 and parallel side walls 110, 112 only slightly smaller than the side walls of the bag 72. The insert 76 folds into a flat structure which, along with the collapsed bag 72, is shipped in a collapsed position. It is accordingly seen that the insert structure 100 lies parallel to a central longitudinal axis 102 of the bag 72.

Use of the package 70 should now be apparent. When a customer desires a purchase to be wrapped, the sales clerk retrieves one of the packages 70 of this invention which are delivered in a collapsed configuration similar to FIG. 2. The sales clerk opens the bag 72, places the insert 76 therein, wraps the purchase in tissue paper or other suitable packing material, inserts the wrapped purchase into the bag 72, and places the lid 74 on the open mouth 86 of the bag 72. If desired, suitable decorative ribbons (not shown) may be wrapped about the bag 72 and lid 74 and decorative ribbon bows (not shown) or other decorations, tags or like may be affixed to the package 70. The time necessary to place the purchase in the package 70 and complete the wrapping is slightly faster than the package 10 because the clerk does not have to consciously deal with the handles 78.

Although the invention has been disclosed and described in its preferred forms with a certain degree of particularly, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A gift wrapping package comprising a bag of a sheet of bodily flexible material folded to provide a flat bottom, front and back parallel walls, first and second side walls, and an upper edge, the bag being foldable from a first collapsed position in which the front and back walls substantially juxtapose to an open position in which the front and back walls are substantially parallel and the first and second side walls are substantially perpendicular to the front and back walls providing a rectilinear mouth opening into the bag;

a lid comprising a sheet of backing material substantially more rigid than the bag material including a generally flat upper section and a rectilinear peripheral lip depending from the upper section and an outer decorative sheet of the same material as the bag material, the outer decorative sheet being affixed to the backing sheet, and lid being supported on the upper bag edge and closing the mouth in the open position of the bag;

a handle affixed to the bag and of a length sufficient to extend past the lid and mouth; and an insert, in the bag, holding the bag in the open position.

2. The package of claim 1 wherein the bag includes an upper end and a lower end and the handle is affixed to the bag intermediate the ends thereof and extends alongside the peripheral lip past the lid and mouth.

3. The package of claim 1 wherein the lid comprises an upper lid section providing a slot receiving the handle therethrough.

4. The package of claim 1 wherein the side walls provide parallel fold lines extending toward the mouth of the bag.

5. The package of claim 4 wherein the handle comprises a first handle affixed to the front wall and further comprising a second handle affixed to the back wall and comprising a mirror image of the first handle.

6. The package of claim 4 wherein the insert comprises a bottom, made of a sheet of material substantially stiffer than the bag material, bonded to the bag bottom.

7. The package of claim 4 wherein the insert comprises means supporting the side walls in parallel position and preventing the side walls from being folded along the fold lines thereof.

8. A gift wrapping package comprising a bag made of a sheet of material folded to provide a flat bottom, front and back parallel walls, first and second side walls, and an upper end reverted to provide a first fold and a region of double material thickness, the bag being foldable from a first collapsed position in which the front and back walls substantially juxtapose to an open position providing a mouth opening into the bag; and means holding the side walls of the bag upright when the bag mouth is open and the bag is resting on the flat bottom including an insert received at a first insert end in the first fold adjacent the bag mouth and abutting the flat bottom at a second end insert thereof.

9. The package of claim 8 wherein the bag comprises a support, stiffer than the bag material, bonded to the flat bottom and providing means for receiving the second insert end.

10. The package of claim 9 wherein the support comprises a slot adjacent the junction of the flat bottom and one of the sidewalls, the slot comprising means for receiving the second insert end.

11. The package of claim 8 wherein the holding means comprises means placing the side walls of the bag in tension and the insert is in compression.

12. A gift wrapping package comprising a bag of a sheet of bodily flexible material folded to provide, in an open position thereof, a flat bottom and an upper bag edge providing a rectilinear mouth opening into the bag;

an insert, in the bag, holding the bag in the open position;

a handle affixed to the bag and of a length sufficient to extend past the mouth of the bag; and a lid comprising a sheet of backing material substantially more rigid than the bag material comprising a generally flat upper section and a rectilinear peripheral lip depending from the upper section and an outer decorative sheet of the same material as the bag material, the outer decorative sheet being affixed to the backing sheet, the lid being supported on the upper bag edge, closing the mouth in the open position of the bag and giving the package the appearance of a box.

13. A gift wrapping package comprising a container of a sheet of material folded to provide a flat bottom, front and back parallel walls, first and second side walls, and an upper container edge, the container being foldable from a first collapsed position to a self supporting upright open position in which the front and back walls are substantially parallel and the first and second side walls are substantially perpendicular to the front and back walls providing a rectilinear mouth opening into the container;

a handle affixed to the container and of a length sufficient to extend past the mouth of the container; and a lid of a substantially rigid backing sheet material comprising a generally flat upper section and a rectilinear peripheral lip depending from the upper section and an outer decorative sheet substantially more flexible than the backing sheet, the outer decorative sheet being affixed to the backing sheet, the lid being supported on the upper container edge, closing the mouth in the open position of the container and giving the package the appearance of a box;

the container material and the lid material having an exterior side of the same finish.

14. A gift wrapping package comprising a container of a sheet of material folded to provide a flat bottom, front and back parallel walls, first and second side walls, and an upper container edge, the container being foldable from a first collapsed position in which the front and back walls substantially juxtapose to a self supporting upright open position in which the front and back walls are substantially parallel and the first and second side walls are substantially perpendicular to the front and back walls providing a rectilinear mouth opening into the container;

a handle affixed to the container and of a length sufficient to extend past the mouth of the container; and a lid comprising a substantially rigid backing sheet having a generally flat upper section and a rectilinear peripheral lip depending from the upper section, the lid being supported on the upper container edge, closing the mouth in the open position of the container and giving the package the appearance of a box; and an outer decorative sheet substantially more flexible than the backing sheet, the outer decorative sheet being affixed to the backing sheet.

* * * * *

UNITED STATES PATENT AND TRADEMARK OFFICE

CERTIFICATE OF CORRECTION

PATENT NO. : 4,930,903

DATED : June 5, 1990

INVENTOR(S) : William M. Mahoney

It is certified that error appears in the above-identified patent and that said Letters Patent is hereby corrected as shown below:

ON TITLE PAGE: Item [63] Related U.S. Application Data, should read "Continuation of Ser. No. 232,225, Aug. 15, 1988 now abandoned."

Column 2, line 57, "is" should be --it--.

Column 3, line 22, after "40" insert --to--.

Column 4, line 20, "comprise" should be --comprises--.

Signed and Sealed this

Thirty-first Day of December, 1991

*Attest:*

HARRY F. MANBECK, JR.

*Attesting Officer*

*Commissioner of Patents and Trademarks*